US011174876B2

(12) United States Patent
Mitorida et al.

(10) Patent No.: US 11,174,876 B2
(45) Date of Patent: Nov. 16, 2021

(54) BLOWER

(71) Applicant: FUJIFILM Business Innovation Corp., Minato-ku (JP)

(72) Inventors: Shinya Mitorida, Kanagawa (JP); Ko Umenai, Kanagawa (JP)

(73) Assignee: FUJIFILM BUSINESS INNOVATION CORP., Tokyo (JP)

( * ) Notice: Subject to any disclaimer, the term of this patent is extended or adjusted under 35 U.S.C. 154(b) by 252 days.

(21) Appl. No.: 16/109,782

(22) Filed: Aug. 23, 2018

(65) Prior Publication Data

US 2019/0113053 A1 Apr. 18, 2019

(30) Foreign Application Priority Data

Oct. 12, 2017 (JP) ..... JP2017-198842

(51) Int. Cl.

| | |
|---|---|
| ***F04D 29/66*** | (2006.01) |
| ***G03G 21/20*** | (2006.01) |
| ***F04D 25/08*** | (2006.01) |
| ***F04D 25/16*** | (2006.01) |
| ***F04D 29/42*** | (2006.01) |

(52) U.S. Cl.

CPC ..... *F04D 29/668* (2013.01); *F04D 25/08* (2013.01); *F04D 25/166* (2013.01); *F04D 29/4226* (2013.01); *F04D 29/4246* (2013.01); *G03G 21/206* (2013.01)

(58) Field of Classification Search

None

See application file for complete search history.

(56) References Cited

U.S. PATENT DOCUMENTS 4,711,135 A * 12/1987 Horiuchi ..... B60K 20/04 248/635
6,084,622 A * 7/2000 Sugiura ..... B41J 2/435 347/170
6,193,478 B1 * 2/2001 Lin ..... F04D 19/002 415/213.1
8,335,082 B2 * 12/2012 Sun ..... G06F 1/20 361/695
8,547,693 B2 * 10/2013 Chen ..... G06F 1/183 361/679.5
8,587,942 B2 * 11/2013 Xu ..... G06F 1/20 361/695

(Continued)

FOREIGN PATENT DOCUMENTS

JP 59-114500 U 8/1984
JP 01-232200 A 9/1989

(Continued)

OTHER PUBLICATIONS

Japanese Office Action dated Jul. 6, 2021 for Japanese Patent Application No. 2017-198842.

*Primary Examiner* — Michael Lebentritt
*Assistant Examiner* — Jason G Davis
(74) *Attorney, Agent, or Firm* — Volpe Koenig

(57) ABSTRACT

A blower includes a fan that sends out air, a guiding member that guides air moving towards the fan or the air sent out by the fan, and a vibration suppressing member that is provided on a side opposite to a side where the guiding member is provided with the fan interposed therebetween, and that reduces vibration of the fan.

9 Claims, 8 Drawing Sheets

(56) References Cited

U.S. PATENT DOCUMENTS

| | | | | |
|---|---|---|---|---|
| 8,939,723 | B2 * | 1/2015 | Kuo | H05K 7/20172 415/213.1 |
| 2006/0032616 | A1 * | 2/2006 | Yang | H01L 23/467 165/104.33 |
| 2006/0138812 | A1 * | 6/2006 | Aoki | B60N 2/5642 297/180.14 |
| 2007/0154300 | A1 * | 7/2007 | Liang | F04D 29/668 415/119 |
| 2008/0251337 | A1 | 10/2008 | Itabashi et al. | |

FOREIGN PATENT DOCUMENTS

| | | | |
|---|---|---|---|
| JP | 03-047500 | A | 2/1991 |
| JP | 04-062398 | U1 | 5/1992 |
| JP | H09270975 | | 10/1997 |
| JP | 2001-178098 | A | 6/2001 |
| JP | 2008-262065 | A | 10/2008 |
| JP | 2010-261543 | A | 11/2010 |
| JP | 2011151206 | | 8/2011 |

* cited by examiner

BLOWER

CROSS-REFERENCE TO RELATED APPLICATIONS

This application is based on and claims priority under 35 USC 119 from Japanese Patent Application No. 2017-198842 filed Oct. 12, 2017.

BACKGROUND

Technical Field

The present invention relates to a blower.

SUMMARY

According to an aspect of the invention, there is provided a blower including a fan that sends out air, a guiding member that guides air moving towards the fan or the air sent out by the fan, and a vibration suppressing member that is provided on a side opposite to a side where the guiding member is provided with the fan interposed therebetween, and that reduces vibration of the fan.

BRIEF DESCRIPTION OF THE DRAWINGS

An exemplary embodiment of the present invention will be described in detail based on the following figures, wherein.

DETAILED DESCRIPTION

An exemplary embodiment of the present invention is described in detail below with reference to the attached drawings.

Figure 1:
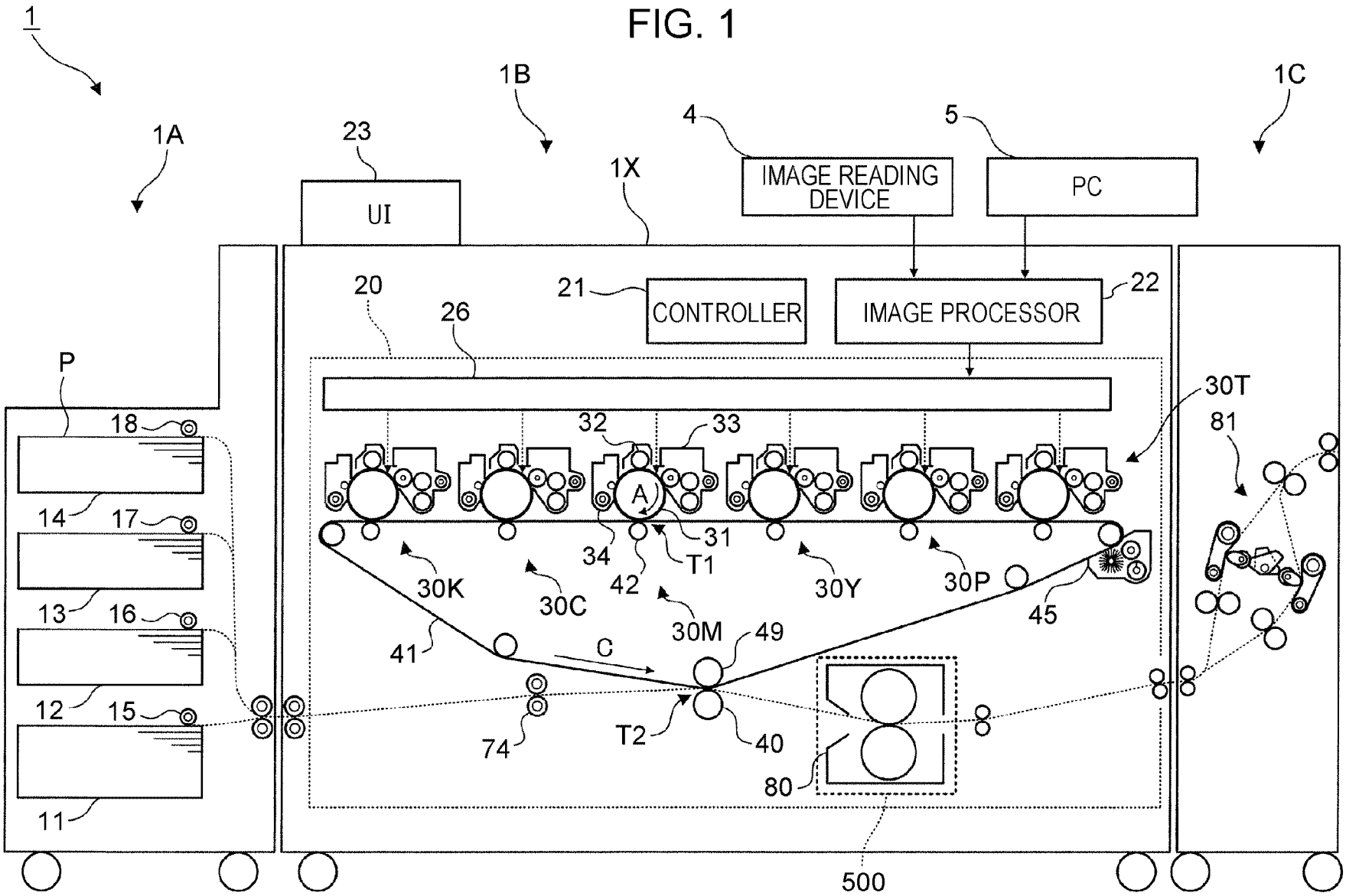
FIG. 1 is a diagram that illustrates an image forming apparatus.

FIG. 1 is a diagram that illustrates an image forming apparatus 1.

The image forming apparatus 1 according to an exemplary embodiment includes a sheet-feeding unit 1A, an image formation unit 1B, and a sheet-discharging unit 1C.

The sheet-feeding unit 1A includes a first sheet accommodating section 11 to a fourth sheet accommodating section 14, which accommodate sheets P as exemplary recording materials. In addition, the sheet-feeding unit 1A includes send-out rollers 15 to 18 that are provided in accordance with the respective first sheet accommodating section 11 to fourth sheet accommodating section 14 and that send out the sheets P accommodated in the corresponding sheet accommodating sections to a transport path connected to the image formation unit 1B.

The image formation unit 1B includes an image formation process section 20 that forms an image on a sheet P and a controller 21 that controls, for example, the image formation process section 20.

In addition, the image formation unit 1B includes an image processor 22. The image processor 22 performs image processing on image data transmitted from an image reading device 4 and a personal computer (PC) 5.

In addition, the image formation unit 1B includes a UI (User Interface) 23 that is formed from, for example, a display device and that notifies a user about information and that accepts information input from the user.

The image formation process section 20, which is an example of an image formation section, includes six image forming units 30T, 30P, 30Y, 30M, 30C, and 30K (may hereunder be simply called "image forming units 30") that are arranged side by side at certain intervals.

Each image forming unit 30 includes a photoconductor drum 31 on which an electrostatic latent image is formed while rotating in the direction of arrow A, a charging roller 32 that charges the surface of the photoconductor drum 31, a developing unit 33 that develops the electrostatic latent image formed on the corresponding photoconductor drum 31, and a drum cleaner 34 that removes, for example, untransferred toner on the surface of the corresponding photoconductor drum 31.

In addition, the image formation process section 20 is provided with a laser exposing device 26 that scans and exposes the photoconductor drums of the respective image forming units 30 by using laser light.

The image forming units 30 have substantially the same structure except that the toners that their developing units 33 contain differ from each other. The image forming unit 30Y, the image forming unit 30M, the image forming unit 30C, and the image forming unit 30K form, respectively, a yellow (Y) toner image, a magenta (M) toner image, a cyan (C) toner image, and a black (K) toner image.

The image forming units 30T and 30P form toner images by using, for example, toner having a corporate color for a specific user only, foam toner for braille, toner having a fluorescent color, toner that improves gloss.

In addition, the image formation process section 20 is provided with an intermediate transfer belt 41 on which are transferred the toner images of the respective colors formed on the photoconductor drums 31 of the respective image forming units 30.

Further, the image formation process section 20 is provided with first transfer rollers 42 that successively transfer (first-transfer) the toner images of the respective colors in the respective image forming units 30 onto the intermediate transfer belt 41 at respective first transfer sections T1.

Still further, the image formation process section 20 is provided with a second transfer roller 40 that, at a second transfer section T2, collectively transfers (second-transfers) the toner images transferred on the intermediate transfer belt 41 onto a sheet P, a belt cleaner 45 that removes, for example, untransferred toner on a surface of the intermediate transfer belt 41, and a fixing unit 80 that fixes the second-transferred images to the sheet P.

Still further, a blower 500 that sends air in the inside of the image formation unit 1B to the outside of the image formation unit 1B is provided behind the fixing unit 80 (that is, at a far side of the fixing unit 80 in a depth direction of the image formation unit 1B). In other words, the blower 500 that sends air in the inside of a device body 1X that forms the image formation unit 1B to the outside of the device body 1X is provided behind the fixing unit 80.

In the exemplary embodiment, the blower 500 discharges to the outside of the image formation unit 1B heat in the inside of the image formation unit 1B and suspended substances that are suspended in the inside of the image formation unit 1B.

On the basis of a control signal from the controller 21, the image formation process section 20 performs an image forming operation. More specifically, first, the image processor 22 performs image processing with respect to image data input from the image reading device 4 and the PC 5, and the image data subjected to the image processing is supplied to the laser exposing device 26.

Then, at, for example, the image forming unit 30M for magenta (M), after charging the surface of the photoconductor drum 31 by the charging roller 32, the laser exposing device 26 irradiates the photoconductor drum 31 with laser light modulated on the basis of the image data acquired from the image processor 22.

By this, an electrostatic latent image is formed on the photoconductor drum 31. The formed electrostatic latent image is developed by the developing unit 33, and a magenta toner image is formed on the photoconductor drum 31.

Similarly, at the image forming unit 30Y, the image forming unit 30C, and the image forming unit 30K, a yellow toner image, a cyan toner image, and a black toner image are formed, respectively; and, at the image forming units 30T and 30P, toner images of, for example, special colors are formed.

The toner images of the respective colors formed at the respective image forming units 30 are successively electrostatically transferred (first-transferred) by the first transfer rollers 42 onto the intermediate transfer belt 41 that rotates in the direction of arrow C in FIG. 1, and the superimposed toner images are formed on the intermediate transfer belt 41.

Due to the movement of the intermediate transfer belt 41, the superimposed toner images formed on the intermediate transfer belt 41 are transported to the second transfer section T2 formed by the second transfer roller 40 and a backup roller 49.

On the other hand, for example, a sheet P is taken out from the first sheet accommodating section 11 by using the send-out roller 15, and, then, is transported to the position of registration rollers 74 via a transport path.

When the superimposed toner images are transported to the second transfer section T2, the sheet P is supplied to the second transfer section T2 from the registration rollers 74 in accordance with a timing in which the superimposed toner images are transported to the second transfer section T2. Then, by the action of a transfer electric field produced between the second transfer roller 40 and the backup roller 49, the superimposed toner images are collectively electrostatically transferred (second-transferred) onto the sheet P.

Thereafter, the sheet P onto which the superimposed toner images have been electrostatically transferred is peeled off from the intermediate transfer belt 41 and is transported to the fixing unit 80. The toner images on the sheet P that have not been fixed and that have been transported to the fixing unit 80 are fixed to the sheet P by being subjected to fixing processing performed by the fixing unit 80 by using heat and pressure.

Then, the sheet P on which the fixed images have been formed is transported to a sheet stacking section (not shown) via a curl straightening section 81 provided at the sheet-discharging unit 1C.

Figure 2:
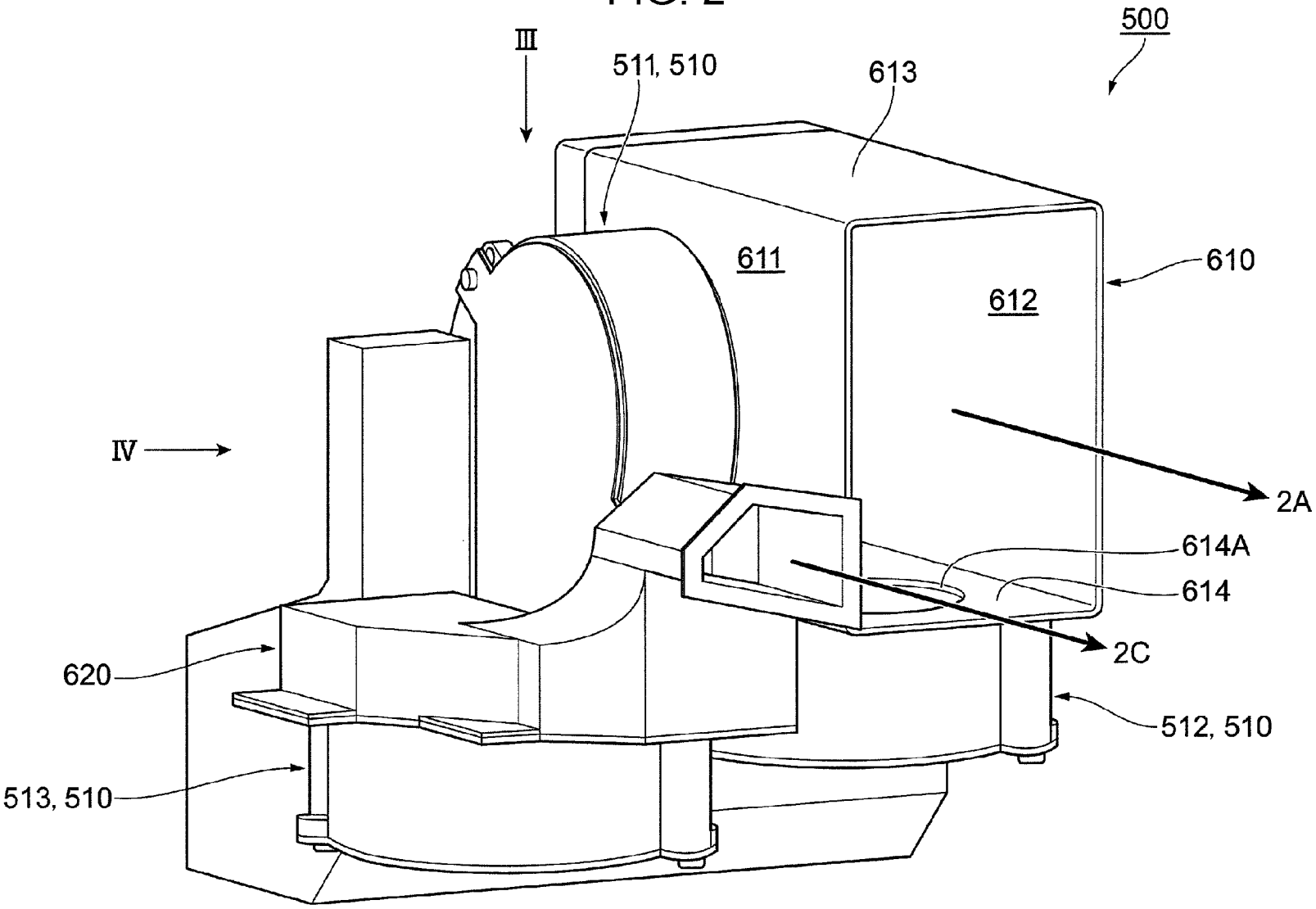
FIG. 2 is a diagram that illustrates a blower.
Figure 3:
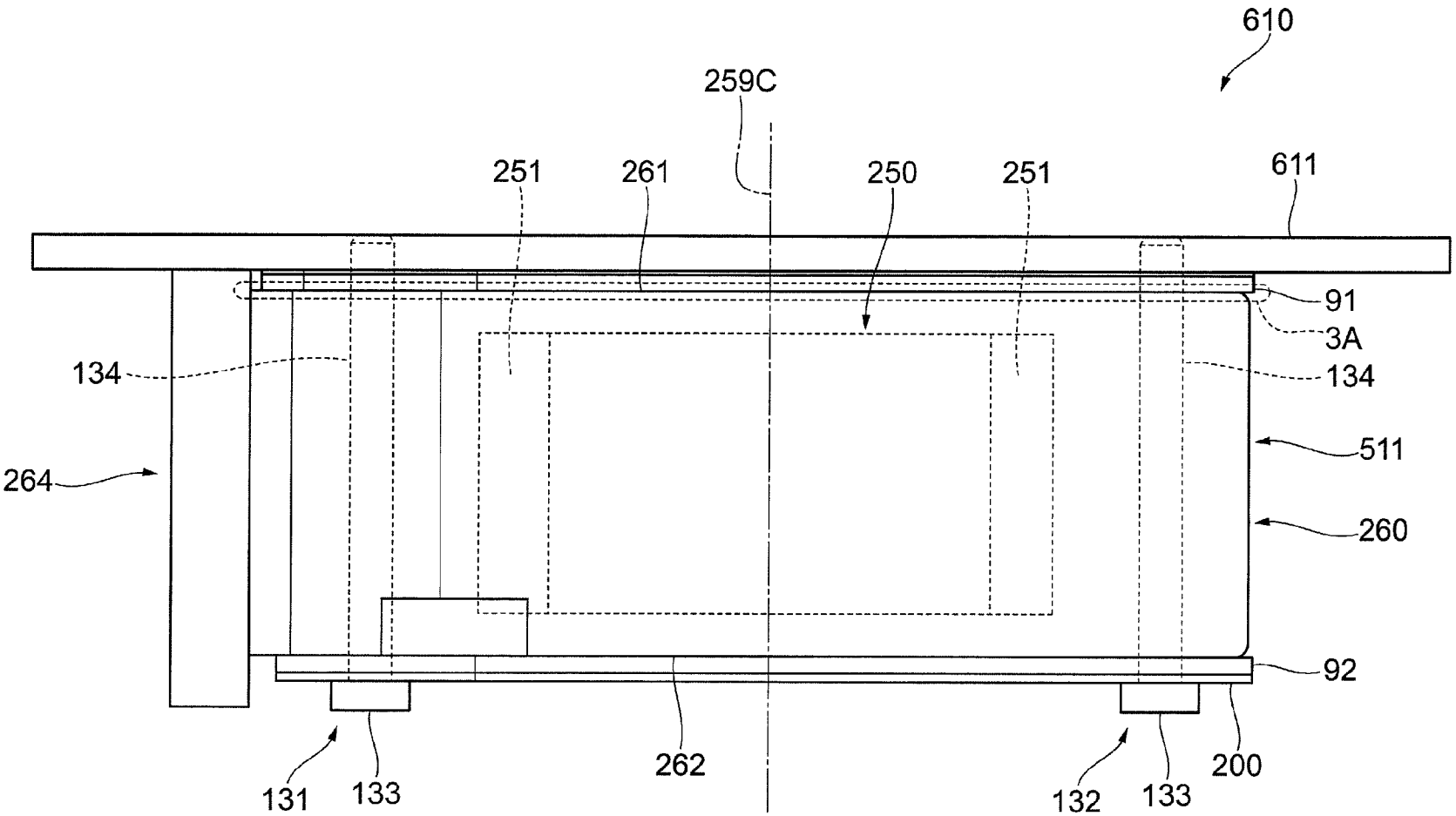
FIG. 3 is a diagram when a part of the blower is viewed from the direction of arrow III in FIG. 2.

FIG. 2 is a diagram that illustrates the blower 500. FIG. 3 is a diagram when a part of the blower 500 is viewed from the direction of arrow III in FIG. 2.

As shown in FIG. 2, the blower 500 is provided with three fans 510, a first fan 511 to a third fan 513. Further, the blower 500 is provided with a first guiding member 610 that guides air sent out by the first fan 511 and the second fan 512. Further, the blower 500 is provided with a second guiding member 620 that guides air sent out by the third fan 513.

The first guiding member 610 is formed from a cylindrical member that is rectangular in cross section. That is to say, the first guiding member 610 is formed from a duct that is rectangular in cross section.

The first guiding member 610 includes a first wall portion 611, a second wall portion 612 facing the first wall portion 611, a third wall portion 613, and a fourth wall portion 614 facing the third wall portion 613. The first fan 511 is fixed to the first wall portion 611, and the second fan 512 is fixed to the fourth wall portion 614.

The fourth wall portion 614 has a circular through hole 614A. Air sent out by the second fan 512 moves into the first guiding member 610 via the through hole 614A.

In addition, although not illustrated, air sent out by the first fan 511 also moves into the first guiding member 610 via a through hole formed in the first wall portion 611.

Then, the air that has moved into the first guiding member 610 moves in the direction of arrow 2A in FIG. 2, and is finally discharged to the outside of the image formation unit 1B (see FIG. 1).

The third fan 513 is mounted on a lower surface of the second guiding member 620.

After air sent out by the third fan 513 has entered the second guiding member 620, the air is discharged in the direction of arrow 2C in FIG. 2 from the second guiding member 620. Then, the discharged air is finally discharged to the outside of the image formation unit 1B.

Here, the first fan 511 is described in detail. The second fan 512 and the third fan 513 have the same structure as the first fan 511.

As shown in FIG. 3, in the exemplary embodiment, a first elastic sheet 91 is provided between the first fan 511 and (the first wall portion 611 of) the first guiding member 610.

By this, the vibration from the first fan 511 is not easily transmitted to the first guiding member 610, so that the vibration of the first guiding member 610 becomes small.

In the structure of the exemplary embodiment, the vibration of the first fan 511 causes the entire blower 500 to vibration, and causes noise to be produced at the blower 500.

When the first elastic sheet 91 is provided, the vibration is not easily transmitted from the first fan 511 to the first guiding member 610, so that the vibration of the blower 500 is reduced and the noise that is produced at the blower 500 is reduced.

The first elastic sheet 91 has a through hole at a central portion thereof in a radial direction. Air sent out from the first fan 511 moves towards the inside of the first guiding member 610 via this through hole.

Further, in the exemplary embodiment, a vibration suppressing member 200, which is an exemplary mounting member, is mounted on the first fan 511. This reduces the vibration of the first fan 511.

The vibration suppressing member 200 is provided on a side opposite to a side where the first guiding member 610 is provided with the first fan 511 interposed therebetween.

More specifically, the vibration suppressing member 200 is mounted on a portion of the first fan 511 that is positioned on a side opposite to a portion on which the first guiding member 610 is mounted (a portion indicated by symbol 3A, that is, a first surface 261 (described later) of an accommodating container 260 (described later)).

Further, in the exemplary embodiment, a second elastic sheet 92, which is an exemplary elastic member, is provided between the vibration suppressing member 200 and the first fan 511.

Further, in the exemplary embodiment, a first threaded member 131 and a second threaded member 132 for fixing the first fan 511 to the first guiding member 610 are provided. Here, the term "threaded member" that is used in the exemplary embodiment for fixing the first fan 511 is a concept including a bolt.

The vibration suppressing member 200 is made of a metal material, such as a stainless steel plate, and is heavier than a resin material. In the exemplary embodiment, by mounting the heavy vibration suppressing member 200 on the vibrating first fan 511, the shaking of the first fan 511 is reduced.

The first threaded member 131 and the second threaded member 132 each have a head portion 133.

The head portions 133 are provided on the side opposite to the side where the first guiding member 610 is provided with the first fan 511 interposed therebetween. In the exemplary embodiment, by interposing the first fan 511 between each head portion 133 and the first guiding member 610, the first fan 511 is fixed to the first guiding member 610.

In the structure of the exemplary embodiment, vibration that is produced at the first fan 511 is transmitted to the head portion 133 of the first threaded member 131 and the head portion 133 of the second threaded member 132, after which the vibration is transmitted to the first guiding member 610 via shaft portions 134 whose diameters are smaller than those of the head portions 133.

Therefore, in the exemplary embodiment, by disposing the second elastic sheet 92 between the head portion 133 of the first threaded member 131 and the first fan 511 and between the head portion 133 of the second threaded member 132 and the first fan 511, vibration is not easily transmitted to the head portions 133 from the first fan 511.

By this, the vibration that is transmitted to the first guiding member 610 from the first fan 511 via the first threaded member 131 and the second threaded member 132 becomes small.

The first elastic sheet 91 and the second elastic sheet 92 are each an elastic plate-shaped member, and are each formed from, for example, a rubber sheet. Alternatively, the first elastic sheet 91 and the second elastic sheet 92 may be formed from, for example, a silicon sheet.

Further, in the exemplary embodiment, the vibration suppressing member 200 is disposed between the head portion 133 of the first threaded member 131 and the second elastic sheet 92 and between the head portion 133 of the second threaded member 132 and the second elastic sheet 92.

More specifically, in the exemplary embodiment, the common vibration suppressing member 200 (single vibration suppressing member 200) is provided between the head portion 133 of the first threaded member 131 and the second elastic sheet 92 and between the head portion 133 of the second threaded member 132 and the second elastic sheet 92.

By this, compared to when the head portion 133 of the first threaded member 131 and the head portion 133 of the second threaded member 132 directly contact the second elastic sheet 92, the pressure per unit area that acts upon the second elastic sheet 92 from the head portions 133 is reduced. Therefore, the second elastic sheet 92 is, for example, not easily weakened or damaged.

When the vibration suppressing member 200 is provided, the first threaded member 131 and the second threaded member do not easily loosen compared to when the head portion 133 of the first threaded member 131 and the head portion 133 of the second threaded member 132 directly contact the second elastic sheet 92.

Here, the first fan 511 is a so-called sirocco fan (multi-blade fan), and includes therein a rotary member 250 including multiple blades 251. Each blade 251 is long in an axial direction of the rotary member 250 and is short in a radial direction of the rotary member 250.

Further, the first fan 511 is provided with the accommodating container 260 that accommodates the rotary member 250 and a motor (not shown) that rotates the rotary member 250.

The accommodating container 260 is made of a resin material. Therefore, in the exemplary embodiment, the specific gravity of the vibration suppressing member 200 made of a metal material (formed from a metal member) is larger than the specific gravity of the accommodating container 260.

The accommodating container 260 has the first surface 261 that has a planar shape and that is positioned on the side of the first guiding member 610 and a second surface 262 that also has a planar shape and that is positioned on a side opposite to the first surface 261.

The first surface 261 and the second surface 262 are disposed so as to cross (so as to be orthogonal to) the axial direction of the rotary member 250 (direction in which a rotation axis 259C of the rotary member 250 extends).

Further, in the exemplary embodiment, the first surface 261 has a blow-out opening (not shown) for blowing out air. The vibration suppressing member 200 is mounted on the side of the second surface 262.

Further, in the exemplary embodiment, an outer peripheral surface of the accommodating container 260 has an inlet 264 for taking in air. From the inlet 264, air enters the inside of the first fan 511.

Figure 4:
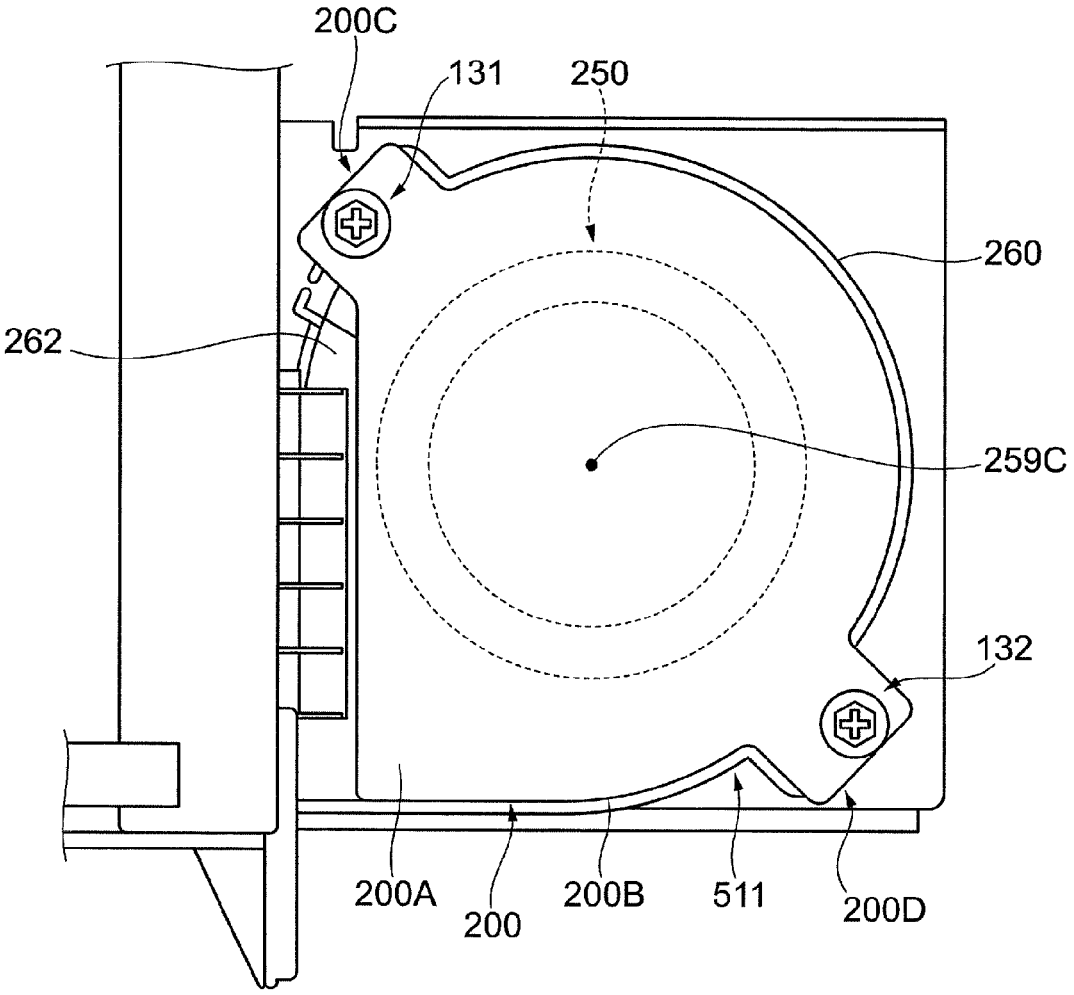
FIG. 4 is a diagram when a first fan is viewed from the direction of arrow IV in FIG. 2.

FIG. 4 is a diagram when the first fan 511 is viewed from the direction of arrow IV in FIG. 2.

As shown in FIG. 4, in the exemplary embodiment, the vibration suppressing member 200 is disposed in a state in which the vibration suppressing member 200 faces the second surface 262 of the accommodating container 260.

In the exemplary embodiment, the substantially plate-shaped vibration suppressing member 200 is pushed against the second surface 262 of the accommodating container 260 by the first threaded member 131 and the second threaded member 132. In other words, the vibration suppressing member 200 is disposed in contact with the second surface 262 of the accommodating container 260 via the second elastic sheet 92 (see FIG. 3).

The vibration suppressing member 200 includes a vibration-suppressing-member body 200A that covers almost the entire second surface 262 of the accommodating container 260, and a first protruding portion 200C and a second protruding portion 200D that protrude from an outer peripheral edge 200B of the vibration-suppressing-member body 200A.

In the exemplary embodiment, the threaded members (first threaded member 131 and second threaded member 132) are inserted into a through hole (not shown) formed in the first protruding portion 200C and a through hole (not shown) formed in the second protruding portion 200D.

Multiple portions of the vibration suppressing member 200 whose positions in the radial direction of the rotary member 250 (direction orthogonal to the axial direction of the rotary member 250) differ from each other are fixed to the first fan 511.

The positions of the first threaded member 131 and the second threaded member 132 in the radial direction of the rotary member 250 differ from each other, so that the multiple portions of the vibration suppressing member 200 whose positions in the radial direction of the rotary member 250 differ from each other are fixed to the first fan 511.

More specifically, at least two portions of the vibration suppressing member 200 are fixed to the first fan 511. These two portions are a portion thereof positioned at one end portion in the radial direction of the rotary member 250 (portion thereof where the first protruding portion 200C is provided) and a portion thereof positioned at the other end portion situated on a side opposite to the one end portion in the radial direction of the rotary member 250 (portion where the second protruding portion 200D is provided).

This reduces the vibration of the first fan 511 compared to when only one portion of the vibration suppressing member 200 is fixed to the first fan 511.

Here, in the structure in which only one portion of the vibration suppressing member 200 is fixed, portions of the vibration suppressing member 200 other than the portion that is fixed to the first fan 511 become free ends, and the portions corresponding to the free ends tend to vibrate by a large amount. In addition, in this case, the vibration suppressing capability of the vibration suppressing member 200 tends to be reduced.

When, as in the exemplary embodiment, a structure in which both end portions of the vibration suppressing member 200 are fixed is used, the vibration suppressing capability of the vibration suppressing member 200 is increased compared to when only one portion of the vibration suppressing member 200 is fixed or when portions other than both end portions of the vibration suppressing member 200 are fixed.

Further, in the exemplary embodiment, the vibration suppressing member 200 is disposed such that the vibration suppressing member 200 is positioned on an extension line of the rotation axis 259C of the rotary member 250.

By this, compared to when the vibration suppressing member 200 is positioned at a location displaced from the extension line of the rotation axis 259C of the rotary member 250 and is decentered with respect to the rotation axis 259C, the vibration of the first fan 511 is reduced.

Further, in the exemplary embodiment, in the radial direction of the rotary member 250, the position of the center of gravity of the vibration suppressing member 200 and the position of the rotation axis 259C of the rotary member 250 substantially coincide with each other. In other words, the center of gravity of the vibration suppressing member 200 is positioned on the extension line of the rotation axis 259C of the rotary member 250.

Further, in the exemplary embodiment, the vibration suppressing member 200 is disposed so as to face substantially the entire second surface 262 of the first fan 511. By this, compared to when the vibration suppressing member 200 is disposed so as to face a part of the second surface 262, the vibration of the first fan 511 is reduced.

Here, the expression "the vibration suppressing member 200 is disposed so as to face substantially the entire second surface 262" means a state in which the vibration suppressing member 200 is disposed so as to face a portion of the second surface 262 having an area that is greater than or equal to 80% of the area of the second surface 262.

Although in the description above, the case in which the vibration suppressing member 200 is provided so as to face substantially the entire second surface 262 is described, the vibration suppressing member 200 may be disposed so as to face a part of the second surface 262 instead of the entire second surface 262.

In addition, although in the description above, the vibration suppressing member 200 is mounted on the first fan 511 by screwing, the vibration suppressing member 200 may be mounted on the first fan 511 by other methods, such as bonding.

In addition, the vibration suppressing member 200 that is mounted on the first fan 511 is not limited to one having a substantially plate shape, and may be one having other shapes. More specifically, for example, as shown in FIG. 5 (diagram showing another structural example of the blower 500), a columnar vibration suppressing member 200 may be mounted on the second surface 262 of the first fan 511 by bonding or screwing.

Figure 5:
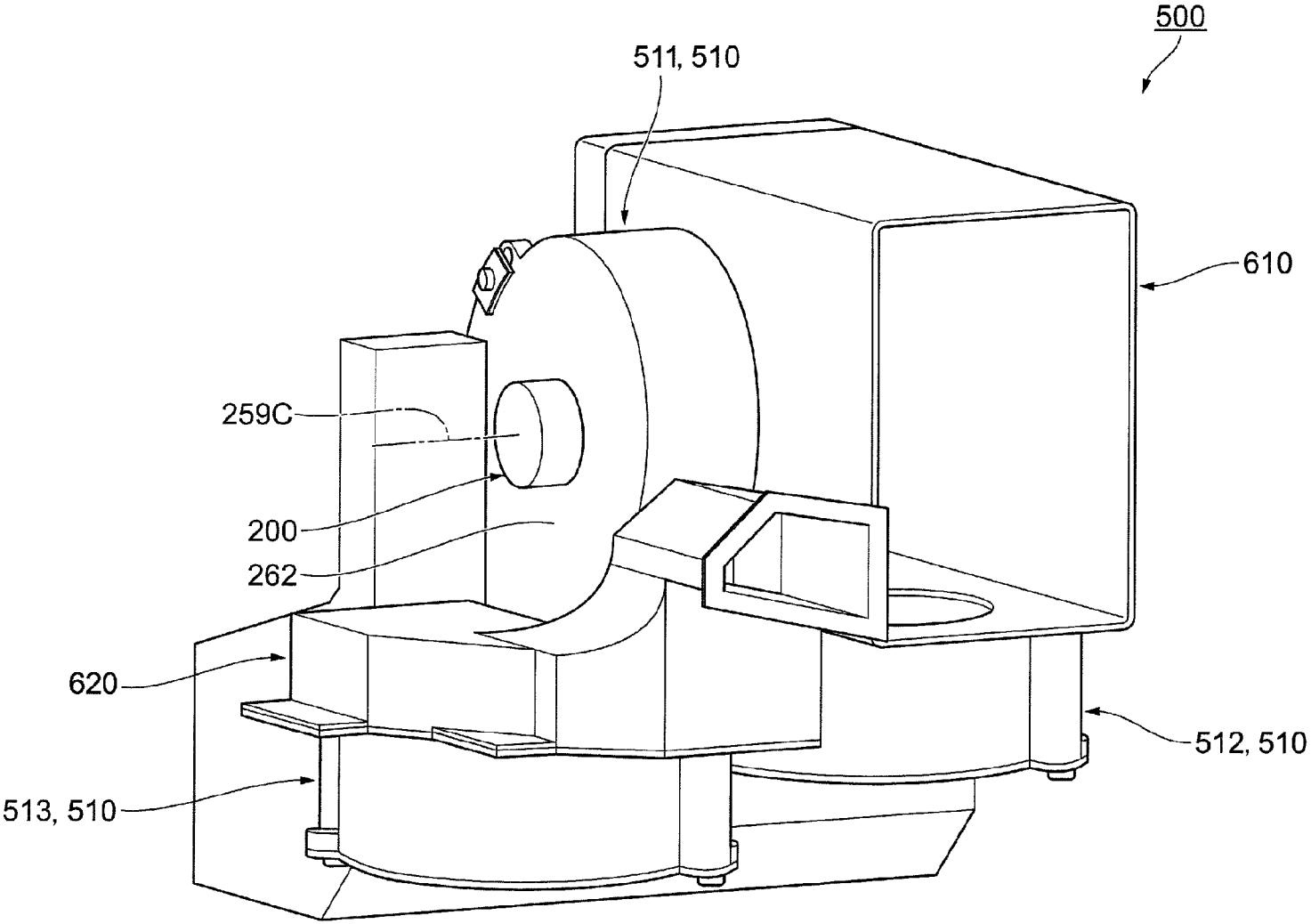
FIG. 5 is a diagram showing another structural example of the blower.

Even in this structural example, as in the description above, the vibration suppressing member 200 is disposed so as to be positioned on the extension line of the rotation axis 259C of the rotary member 250 (not shown in FIG. 5). In addition, even in this structural example, in the radial direction of the rotary member 250, the position of the center of gravity of the vibration suppressing member 200 and the position of the rotation axis 259C of the rotary member 250 substantially coincide with each other.

Although in the description above, the case in which the vibration suppressing member 200 is mounted on a sirocco fan is described, the vibration suppressing member 200 may be mounted on an axial-flow fan.

Figure 6:
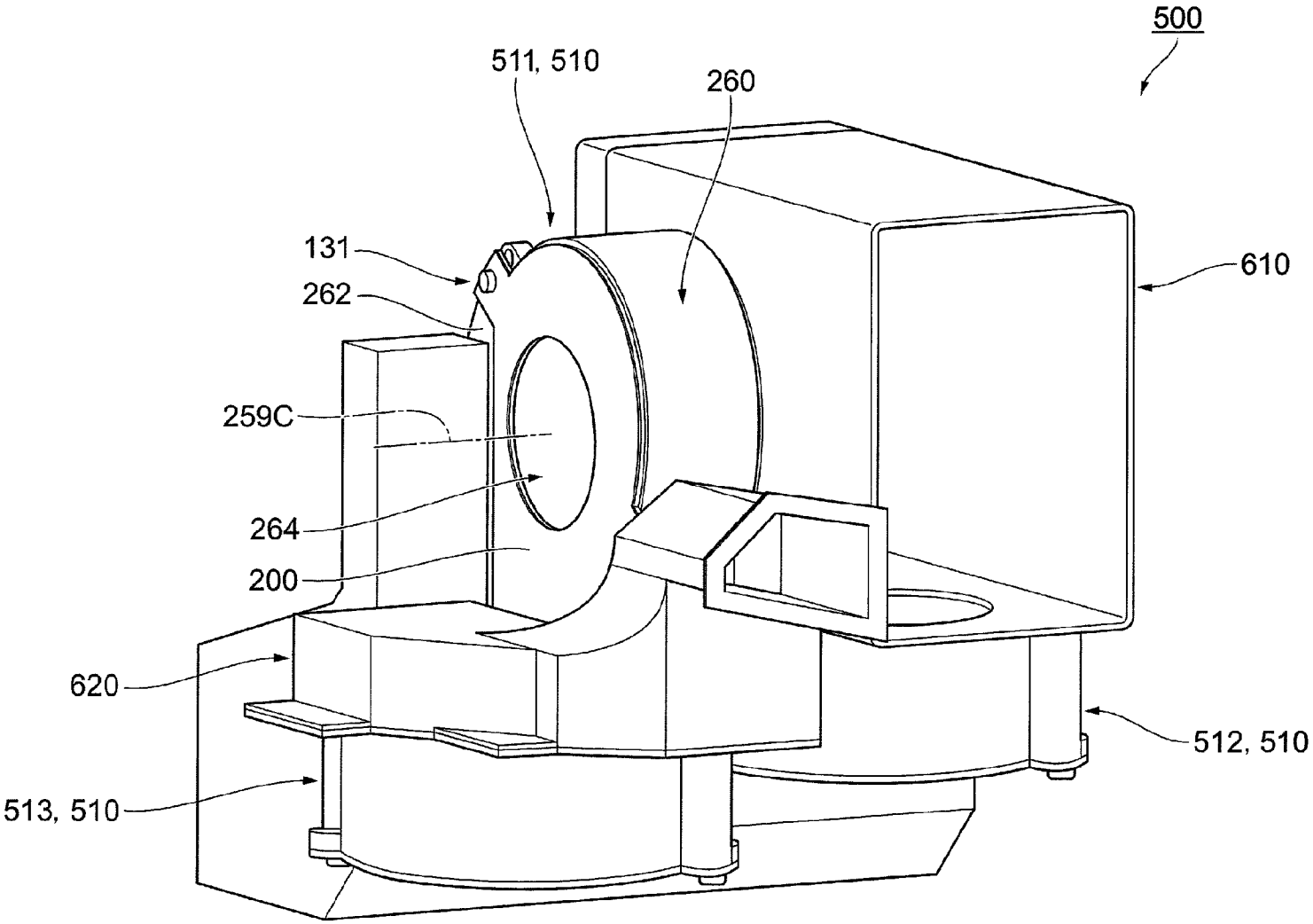
FIG. 6 is a diagram showing the blower when the first fan is formed from an axial-flow fan.

FIG. 6 is a diagram showing the blower 500 when the first fan 511 is formed from an axial-flow fan. In FIG. 6, the rotary member (propeller-type rotary member) that is positioned in the inside of the first fan 511 is not illustrated.

In this structural example, the second surface 262 of the accommodating container 260 of the first fan 511 has an inlet 264 for taking air into the first fan 511.

In addition, in this structural example, a ring-shaped vibration suppressing member 200 is mounted on a portion of the second surface 262 that is positioned around the inlet 264.

Even in this structural example, the vibration of the first fan 511 is reduced by the vibration suppressing member 200, and the vibration of the entire blower 500 is also reduced.

Even in this structural example, the center of gravity of the vibration suppressing member 200 is positioned on the extension line of the rotation axis 259C of the rotary member in the inside of the first fan 511. Therefore, compared to a structure in which the center of gravity of the vibration suppressing member 200 is not positioned on the extension line of the rotation axis 259C, the vibration of the rotation axis 259C, the vibration of the first fan 511 is reduced.

Figure 7:
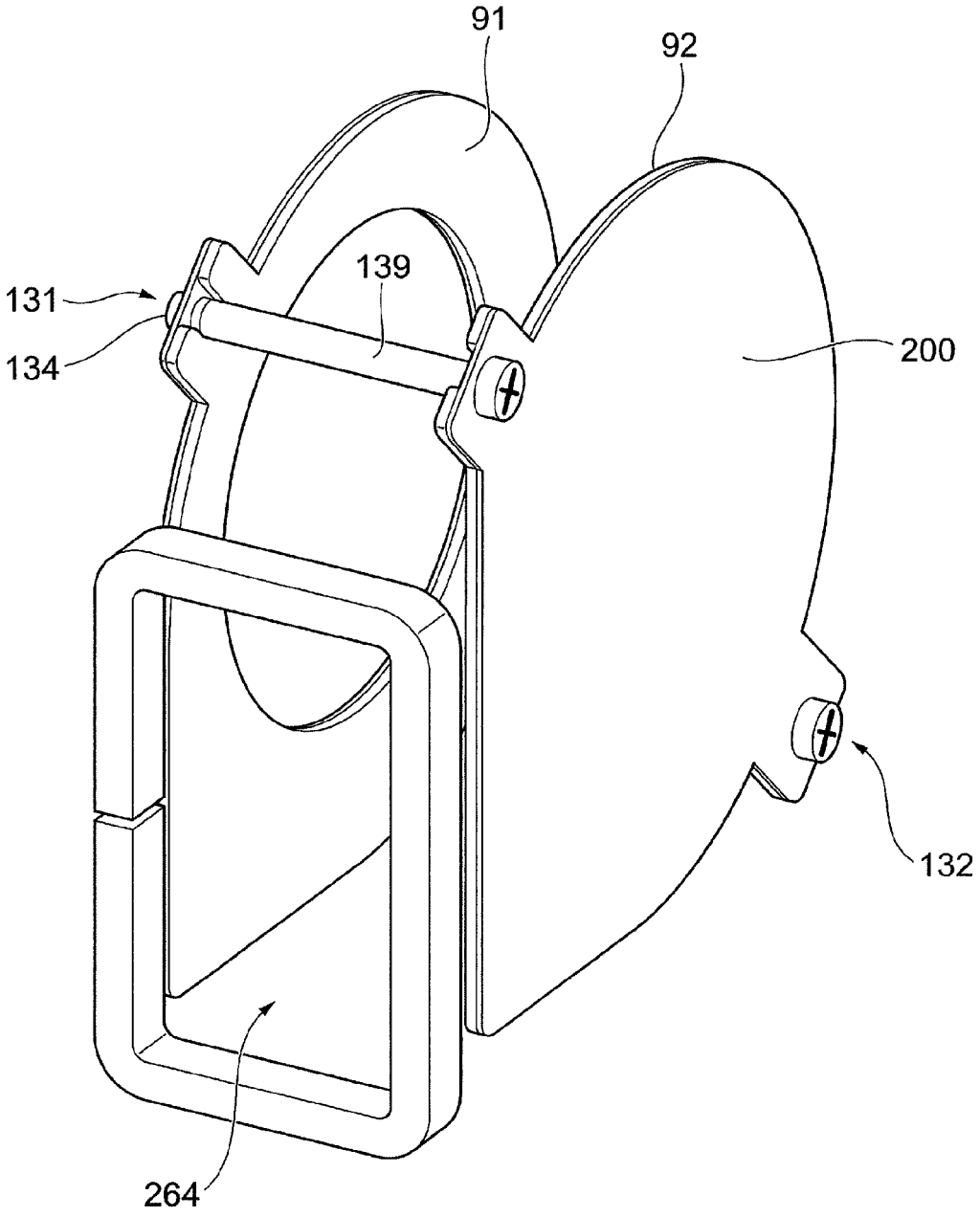
FIG. 7 is a perspective view that illustrates a first threaded member and a second threaded member.

FIG. 7 is a perspective view that illustrates the first threaded member 131 and the second threaded member 132. In FIG. 7, the first fan 511 is not illustrated. Although in the description below, the first threaded member 131 is described, the second threaded member 132 has the same structure as the first threaded member 131.

In this structural example shown in FIG. 7, an elastic body 139 is provided around the shaft portion 134 of the first threaded member 131. The elastic body 139 has a cylindrical shape, and the shaft portion 134 of the first threaded member 131 is positioned in the inside of the elastic body 139.

More specifically, the elastic body 139 is formed by winding a resin tape around the shaft portion 134 of the first threaded member 131.

Depending upon the inside diameter of a through hole of the first fan 511 into which the first threaded member 131 is inserted and the outside diameter of the shaft portion 134 of the first threaded member 131, the shaft portion 134 of the first threaded member 131 and the first fan 511 contact each other. In addition, in this case, the vibration that is produced at the first fan 511 is transmitted to the first guiding member 610 via the shaft portion 134.

As in the structural example shown in FIG. 7, when the elastic body 139 is provided around the shaft portion 134, the vibration that is transmitted to the first guiding member 610 via the shaft portion 134 is reduced.

Figure 8:
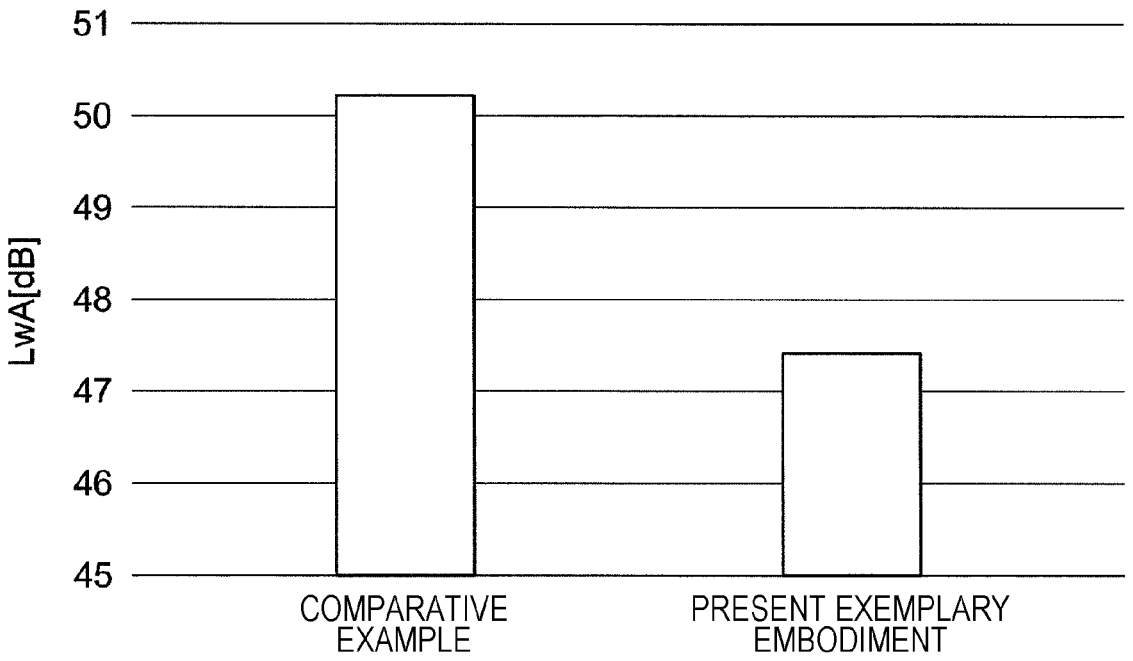
FIG. 8 is a diagram showing the loudness of noise that is produced by the blower and the loudness of noise that is produced by a blower of a comparative example.

FIG. 8 is a diagram showing the loudness of noise that is produced by the blower 500 of the exemplary embodiment and the loudness of noise that is produced by a blower 500 of a comparative example. The blower 500 of the comparative example has a structure in which a vibration suppressing member 200 and a second elastic sheet 92 are not provided.

As shown in FIG. 8, the loudness of noise in the comparative example is approximately 50.2 dB. In contrast, the loudness of noise in the exemplary embodiment is smaller than 50.2 dB, or approximately 47.4 dB.

Other

In the description above, a mode in which the first guiding member 610 that guides air sent out by the first fan 511 is provided and in which the vibration suppressing member 200 is mounted on a portion of the first fan 511 that is positioned on a side opposite to a portion on which the first guiding member 610 is mounted is described as an example. However, the mode of the blower 500 is not limited to this mode.

There is also a mode of the blower 500 in which, in the direction of flow of air, a guiding member is provided on an upstream side of a fan, and air flowing towards the fan is guided by the guiding member. Even in this mode, as in the description above, by mounting a vibration suppressing member 200 on a portion of the fan that is positioned on a side opposite to a portion on which the guiding member is mounted, the vibration of the blower 500 and the noise that is produced by the blower 500 are suppressed.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A blower comprising:

at least two fans that send out air and are positioned perpendicular to each other;

a guiding member that guides air sent out by at least one of the at least two fans; and a vibration suppressing member that is provided on a side opposite to a side where the guiding member is provided with a first fan of the at least two fans interposed therebetween, and that reduces vibration of the first fan, and wherein the vibration suppressing member is only mounted on the first fan.

2. The blower according to claim 1, wherein the vibration suppressing member is formed from a metal member mounted on the first fan of the at least two fans.

3. The blower according to claim 2, wherein the metal member has a substantially plate shape, and is disposed in a state in which the metal member faces a surface of the first fan and is disposed in contact with the surface.

4. The blower according to claim 1, further comprising:

a threaded member that fixes the first fan of the at least two fans to the guiding member and that includes a shaft portion, wherein an elastic body is provided around the shaft portion of the threaded member.

5. The blower according to claim 1, wherein the first fan of the at least two fans includes a rotary member that sends out air, and wherein a plurality of portions of the vibration suppressing member whose positions in a radial direction of the rotary member differ from each other are fixed to the first fan.

6. The blower according to claim 5, wherein at least two portions of the plurality of portions of the vibration suppressing member are fixed to the first fan, the two portions being a portion positioned at one end portion in the radial direction of the rotary member and a portion positioned at other end portion situated on a side opposite to the one end portion in the radial direction.

7. The blower according to claim 1, wherein the guiding member is mounted on the first fan of the at least two fans, and wherein the vibration suppressing member is mounted on a portion of the first fan that is positioned on a side opposite to a portion on which the guiding member is mounted.

8. A blower comprising:

at least two fans that send out air and are positioned perpendicular to each other;

a guiding member that guides air sent out by at least one of the at least two fans; and a metal member that is mounted on a portion of a first fan of the at least two fans that is positioned on a first side opposite to a side where the guiding member is provided, and wherein the metal member is only mounted on the first fan.

9. A blower comprising:

at least two fans that are positioned perpendicular to each other, one of the at least two fans includes a rotary member and an accommodating container that accommodates the rotary member, the one of the at least two fans sending out air as a result of rotating the rotary member;

a guiding member that guides air sent out by at least one of the at least two fans; and a mounting member that is mounted on a portion of a first fan of the at least two fans that is positioned on a first side opposite to a side where the guiding member is provided, a specific gravity of the mounting member being larger than a specific gravity of the accommodating container, and wherein the mounting member is only mounted on the first fan.

* * * * *